US009854947B2

(12) United States Patent
McNulty et al.

(10) Patent No.: US 9,854,947 B2
(45) Date of Patent: Jan. 2, 2018

(54) HORIZONTAL PUMPS, REFILL UNITS AND FOAM DISPENSERS WITH INTEGRAL AIR COMPRESSORS

(71) Applicant: GOJO Industries, Inc., Akron, OH (US)

(72) Inventors: John J. McNulty, Broadview Heights, OH (US); Robert L. Quinlan, Stow, OH (US); Nick E. Ciavarella, Seven Hills, OH (US); James E. Motyka, Cuyahoga Falls, OH (US); Todd A. Spiegelberg, North Ridgeville, OH (US)

(73) Assignee: GOJO Industries, Inc., Akron, OH (US)

( * ) Notice: Subject to any disclaimer, the term of this patent is extended or adjusted under 35 U.S.C. 154(b) by 181 days.

(21) Appl. No.: 14/797,728

(22) Filed: Jul. 13, 2015

(65) Prior Publication Data

US 2015/0313423 A1 Nov. 5, 2015

Related U.S. Application Data

(63) Continuation of application No. 13/792,034, filed on Mar. 9, 2013, now abandoned.
(Continued)

(51) Int. Cl.
*A47K 5/12* (2006.01)
*A47K 5/14* (2006.01)
(Continued)

(52) U.S. Cl.
CPC ..... *A47K 5/14* (2013.01); *A47K 5/1211* (2013.01); *B05B 7/0025* (2013.01);
(Continued)

(58) Field of Classification Search
CPC ... A47K 5/14; A47K 5/13; A47K 5/12; A47K 5/1202; A47K 5/1204; A47K 5/1211;
(Continued)

(56) References Cited

U.S. PATENT DOCUMENTS 2,904,222 A 9/1959 Philippe
3,851,801 A 12/1974 Roth
(Continued)

FOREIGN PATENT DOCUMENTS

CH 676227 A5 12/1990
CN 100184557 A 5/2008
(Continued)

OTHER PUBLICATIONS

Office Action from U.S. Appl. No. 14/717,429 dated Oct. 6, 2016.
(Continued)

*Primary Examiner* — Patrick M Buechner
(74) *Attorney, Agent, or Firm* — Calfee, Halter & Griswold LLP

(57) ABSTRACT

Foam dispensers having integral air compressors with connectors to connect with a disposable refill unit, disposable refill units and liquid pumps are disclosed herein. A refill unit includes a container and a liquid pump. The liquid pump includes a liquid chamber defined at least in part by a liquid inlet valve and a liquid outlet valve. A piston that reciprocates horizontally in the liquid chamber. A mixing chamber is located downstream of the liquid chamber. The mixing chamber is in fluid communication with the liquid chamber and has an air inlet. A sanitary seal is located proximate the air inlet to prevent liquid from contaminating the air compressors.

20 Claims, 10 Drawing Sheets

Related U.S. Application Data

(60) Provisional application No. 61/692,290, filed on Aug. 23, 2012.

(51) Int. Cl.
*B05B 11/00* (2006.01)
*B05B 7/00* (2006.01)

(52) U.S. Cl.
CPC ..... *B05B 11/3001* (2013.01); *B05B 11/3015* (2013.01); *B05B 11/3087* (2013.01)

(58) Field of Classification Search
CPC ..... B05B 11/0054; B05B 11/3066; B05B 11/3087; B05B 11/3098; B05B 11/3001; B05B 11/3015; B05B 7/0018; B05B 7/005; B05B 7/0056; B05B 7/0025; B05B 7/0062
See application file for complete search history.

(56) References Cited

U.S. PATENT DOCUMENTS 3,995,167 A 11/1976 Kulig
4,168,020 A 9/1979 Benson
4,330,071 A 5/1982 Ohlson
4,493,440 A * 1/1985 von Buelow ..... A47K 5/1204 222/109
4,793,522 A 12/1988 Corsette
4,880,161 A 11/1989 Wright
4,972,978 A * 11/1990 DeLuca ..... A47K 5/1204 222/181.2
4,986,453 A 1/1991 Lina et al.
5,100,030 A 3/1992 Roggenburg et al.
5,174,476 A 12/1992 Steiner et al.
5,209,377 A 5/1993 Steiner et al.
5,271,530 A 12/1993 Uehira et al.
5,439,140 A 8/1995 Meyer
5,439,144 A 8/1995 Holzner
5,445,288 A 8/1995 Banks
5,458,289 A 10/1995 Cater
5,462,208 A 10/1995 Stahley et al.
5,556,005 A * 9/1996 Banks ..... A47K 5/1204 222/105
5,605,256 A * 2/1997 Fan ..... A47K 5/1204 222/181.2
5,791,525 A * 8/1998 Fan ..... A47K 5/1204 222/181.3
5,799,841 A 9/1998 Wirt
5,826,755 A 10/1998 Burd
5,862,954 A 1/1999 Ehrensperger
5,899,363 A 5/1999 Bliss, III et al.
5,906,299 A 5/1999 Hagleitner
6,016,936 A 1/2000 Fan
6,065,647 A 5/2000 Bliss, III et al.
6,082,586 A * 7/2000 Banks ..... A47K 5/14 222/105
6,223,932 B1 5/2001 Usui
6,409,050 B1 6/2002 Ophardt et al.
6,446,840 B2 9/2002 Ophardt et al.
6,557,736 B1 * 5/2003 Ophardt ..... B05B 11/007 222/321.7
6,626,332 B2 9/2003 Ehrensperger et al.
6,971,549 B2 12/2005 Leifheit et al.
7,059,282 B2 6/2006 Vorih et al.
7,377,758 B2 5/2008 Sallows et al.
7,537,140 B2 5/2009 Lin
7,815,076 B2 10/2010 Ophardt
8,528,792 B2 9/2013 Ophardt et al.
8,579,159 B2 11/2013 Ciavarella
8,955,718 B2 2/2015 Ciavarella
9,038,862 B2 * 5/2015 McNulty ..... B05B 7/0025 222/181.1
9,179,808 B2 * 11/2015 McNulty ..... A47K 5/14
9,307,871 B2 * 4/2016 McNulty ..... A47K 5/14
9,392,913 B2 * 7/2016 Quinlan ..... A47K 5/16
2003/0000967 A1 1/2003 Ehrensperger
2003/0075562 A1 4/2003 Gerenraich et al.
2004/0031816 A1 2/2004 Schuman
2004/0065689 A1 4/2004 Pritchett
2004/0206772 A1 10/2004 Leifheit
2005/0205600 A1 9/2005 Ophardt
2006/0175354 A1 * 8/2006 Ophardt ..... A47K 5/1202 222/188
2006/0273114 A1 12/2006 Ophardt
2007/0023454 A1 * 2/2007 Ophardt ..... A47K 5/14 222/190
2007/0158367 A1 7/2007 Lin
2007/0251953 A1 * 11/2007 Criswell ..... A47K 5/1207 222/105
2007/0257064 A1 * 11/2007 Ophardt ..... B05B 11/3001 222/251
2007/0272709 A9 11/2007 Ciavarella et al.
2007/0278247 A1 12/2007 Banks
2007/0284394 A1 * 12/2007 Ophardt ..... B05B 11/0059 222/321.7
2008/0135578 A1 * 6/2008 Ophardt ..... A47K 5/1202 222/136
2008/0272148 A1 11/2008 Malik et al.
2009/0008408 A1 1/2009 Ophardt et al.
2009/0071977 A1 * 3/2009 Abe ..... A47K 5/1204 222/105
2009/0184134 A1 7/2009 Ciavarella et al.
2009/0184136 A1 7/2009 Ciavarella
2009/0230151 A1 9/2009 Ciavarella
2009/0277928 A1 11/2009 Bruckner
2010/0096412 A1 4/2010 Law
2010/0147894 A1 6/2010 Reimann et al.
2010/0232997 A1 * 9/2010 Ophardt ..... B05B 11/0075 417/559
2011/0079614 A1 4/2011 Ganzeboom et al.
2012/0037657 A1 2/2012 Mazzotta
2012/0070104 A1 3/2012 Antonio
2012/0132668 A1 * 5/2012 Ophardt ..... A47K 5/1207 222/1
2012/0217267 A1 8/2012 Bunoz et al.
2013/0112716 A1 5/2013 Law
2013/0119083 A1 5/2013 Ophardt
2013/0299518 A1 11/2013 McNulty et al.
2013/0315031 A1 11/2013 Bunoz et al.
2014/0061246 A1 3/2014 McNulty et al.
2014/0124531 A1 5/2014 Muderlak et al.
2014/0217117 A1 8/2014 Mirbach
2014/0319180 A1 10/2014 Quinlan et al.
2015/0446601 5/2015 Tepas
2015/0216369 A1 8/2015 Hamilton
2015/0266657 A1 * 9/2015 Corney ..... B65D 47/06 222/478
2015/0320266 A1 11/2015 Creaghan
2017/0056907 A1 * 3/2017 Ophardt ..... B05B 11/3087

FOREIGN PATENT DOCUMENTS

EP 1147818 A1 10/2001
EP 2080464 7/2009
EP 2080560 A1 7/2009
GB 1269645 4/1972
GB 2301812 12/1996
GB 2472235 A 2/2011
WO 2005105320 A1 11/2005
WO 2011012836 A1 2/2011
WO 2011157975 A1 12/2011

OTHER PUBLICATIONS

Office Action from Taiwanese Patent Application No. 102130034 dated Sep. 30, 2016 and English translation of Notice.
English translation of First Office Action for Taiwanese Patent Application No. 102146134 dated Jan. 18, 2017.
European Patent Office Search Report dated Jan. 7, 2011 in EP Application No. 09 150 880.2; 4 pages.

(56) References Cited

OTHER PUBLICATIONS

International Search Report and Written Opinion from International Application No. PCT/US2014/035072, dated Jul. 23, 2014.
International Search Report and Written Opinion from International Application No. PCT/US2013/056106, dated Nov. 7, 2013.
International Search Report and Written Opinion from International Application No. PCT/US2013/067158, dated Apr. 11, 2014.
International Search Report and Written Opinion from International Application No. PCT/US2013/067366, dated Apr. 11, 2014.
International Search Report and Written Opinion from International Application No. PCT/US2014/056964, dated Nov. 7, 2013.
International Search Report and Written Opinion from International Application No. PCT/US2013/056549, dated Jan. 15, 2014.

* cited by examiner

HORIZONTAL PUMPS, REFILL UNITS AND FOAM DISPENSERS WITH INTEGRAL AIR COMPRESSORS

RELATED APPLICATIONS

This non-provisional utility patent application is a continuation of and claims priority to and the benefits of U.S. Non-Provisional patent application Ser. No. 13/792,034 filed on Mar. 9, 2013, and entitled HORIZONTAL PUMPS, REFILL UNITS AND FOAM DISPENSERS WITH INTEGRAL AIR COMPRESSORS, which claims priority to U.S. Provisional Patent Application Ser. No. 61/692,290 filed on Aug. 23, 2012, and entitled HORIZONTAL PUMPS, REFILL UNITS AND FOAM DISPENSERS WITH INTEGRAL AIR COMPRESSORS. These applications are incorporated herein by reference in their entirety.

TECHNICAL FIELD

The present invention relates generally to liquid pumps, refill units for foam dispensers and foam dispenser systems, and more particularly to horizontal liquid pumps, refill units and foam dispensers having integral air compressors.

BACKGROUND OF THE INVENTION

Liquid dispenser systems, such as liquid soap and sanitizer dispensers, provide a user with a predetermined amount of liquid upon actuation of the dispenser. In addition, it is sometimes desirable to dispense the liquid in the form of foam by, for example, injecting air into the liquid to create a foamy mixture of liquid and air bubbles. As a general matter, it is usually preferable to reduce the space taken up by the pumping and foaming apparatus within the overall dispenser system. This maximizes the available space for storing the liquid, and has other benefits.

SUMMARY

Pumps, foam refill units and foam dispenser systems are disclosed herein. Embodiments of disposable refill units for foam dispensers that have an integral air compressor are provided. One embodiment includes a container and a liquid pump. The liquid pump includes a liquid chamber defined at least in part by a liquid inlet valve and a liquid outlet valve. A piston reciprocates horizontally in the liquid chamber. A mixing chamber is located downstream of the liquid chamber. The mixing chamber is in fluid communication with the liquid chamber and has an air inlet. A sanitary seal is located proximate the air inlet to allow air to enter the mixing chamber and prevent liquid from exiting the mixing chamber through the air inlet Another embodiment of a disposable refill unit for a foam dispenser is disclosed that has an integral air compressor and includes a container and a liquid pump. The liquid pump has a liquid chamber defined at least in part by a liquid inlet valve and a liquid outlet valve. A mixing chamber is located downstream of the liquid chamber. The mixing chamber includes an air inlet and a sanitary seal located proximate the air inlet. The sanitary seal allows air to enter the mixing chamber and prevents liquid from exiting the mixing chamber through the air inlet. The container, the liquid pump and the sanitary seal are disposable without disposing of the air compressor.

Embodiments of foam dispensers for receiving replaceable refill units are also disclosed. One embodiment of a foam dispenser includes a housing, an actuator and an air compressor. In addition, the dispenser includes a connector that releasably connects the air compressor to an air inlet on a disposable refill unit when the disposable refill unit is installed in the foam dispenser and disconnects from the disposable refill unit when the refill unit is removed. The actuator is configured to move horizontally and actuate the air compressor. In addition, a refill unit mounting bracket is included to receive and releasably retain a replaceable refill unit.

In addition, pumps and refill units having a novel liquid inlet valve are also disclosed herein. In one embodiment, a refill unit includes a container of foamable liquid and a pump secured to the container. The pump includes a pump housing having a first aperture therethrough. A liquid inlet valve is provided through the first aperture. The pump also includes one or more liquid inlet passages through the housing. The liquid inlet valve includes a stem portion. The stem portion includes a projection member on one end and a sealing member on the other. The projection member fits through the aperture from outside of the pump housing and the sealing member is located upstream of the one or more liquid inlets.

BRIEF DESCRIPTION OF THE DRAWINGS

These and other features and advantages of the present invention will become better understood with regard to the following description and accompanying drawings in which.

DETAILED DESCRIPTION

Figure 1:
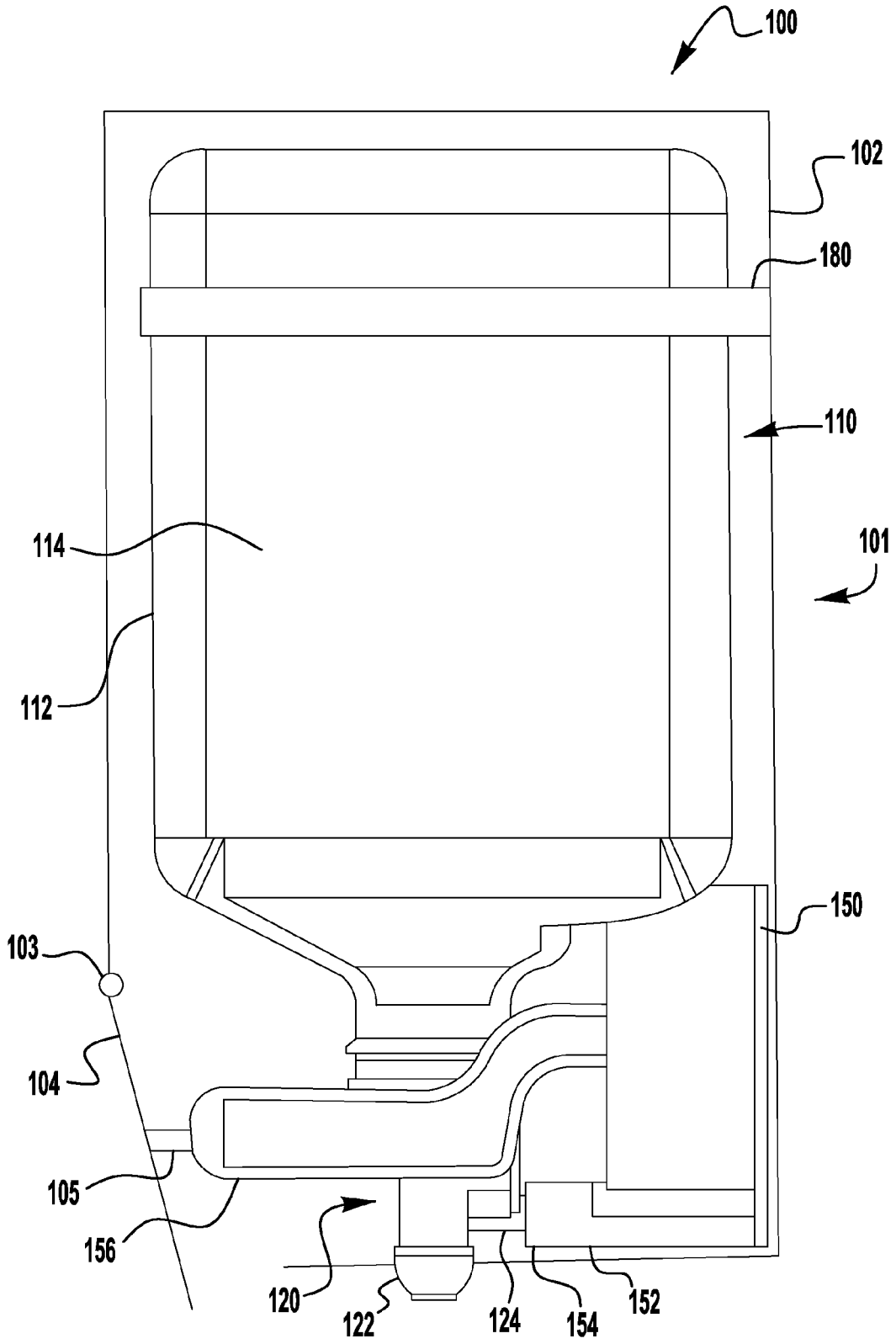
FIG. 1 illustrates a dispenser system 100 having an air compressor 150 attached thereto and a refill unit 110 installed therein.

FIG. 1 illustrates an exemplary embodiment of a foam dispensing system 100 with a side of the housing being transparent. Foam dispensing system 100 includes a disposable refill unit 110 installed in a foam dispenser 101. The disposable refill unit 110 includes a container 112 connected to a liquid pump 120. Liquid pump 120 includes an air inlet 124. The disposable refill unit 110 may be placed within housing 102 of the dispenser 101 and releasably placed in fluid communication with air compressor 150. The term air compressor is used interchangeably herein with the term "air pump."

The foam dispenser system 100 may be a wall-mounted system, a counter-mounted system, an un-mounted portable system movable from place to place or any other kind of foam dispenser system. Foam dispenser 101 includes an air compressor 150 secured thereto. Air compressor 150 may be permanently mounted to foam dispenser 101. Air compressor 150 includes a conduit or air passage 152, with a connector 154 for releasably connecting to the air inlet 124 of liquid pump 120. Optionally, connector 154 may be secured to pump 120. In one embodiment, connector 154 is a two-part connector, and one part is connected to pump 120 and the other to air passage 152. In one embodiment, the connector 154 is made up of a male fitting on one of the liquid pump air inlet 124 or the air passage 152 of air compressor 150 and a female fitting on the other. Accordingly, refill unit 110 and pump 120 may be removed from dispenser housing 102 and discarded without removal of the air compressor 150. Connector 154 may be a quick-release connector, a releasable snap-fit connector, a releasable compression-fit connector, a slip-fit connector or a sealing member such as, for example, a foam or flexible member that compresses to form a seal between air passage 152 and pump 120. The air compressor 150 may be any type of air compressor such as, for example, a compressible bellows, a rotary air compressor, a piston air compressor, a fan, a compressor, a positive displacement pump or the like.

The container 112 forms a liquid reservoir 114. The liquid reservoir 114 contains a supply of a foamable liquid within the disposable refill unit 110. In various embodiments, the contained liquid could be for example a soap, a sanitizer, a cleanser, a disinfectant or some other foamable liquid. In the exemplary disposable refill unit 110, the liquid reservoir 114 is formed by a collapsible container 112, such as a container made of thin plastic or a flexible bag-like container. In other embodiments, the liquid reservoir 114 may be formed by a rigid housing member, or have any other suitable configuration for containing the foamable liquid without leaking. The container 112 may advantageously be refillable, replaceable or both refillable and replaceable. In other embodiments, the container 112 may be neither refillable nor replaceable.

In the event the liquid stored in the reservoir 114 of the installed disposable refill unit 110 runs out, or the installed refill unit 110 otherwise has a failure, the installed refill unit 110 may be removed from the foam dispenser system 100. The empty or failed disposable refill unit 110 may then be replaced with a new disposable refill unit 110 including a liquid-filled reservoir 114. The air compressor 150 remains located within the foam dispenser 101 while the disposable refill unit 110 is replaced. In one embodiment, the air compressor 150 is also removable from the housing 102 of the dispenser 101, separately from the disposable refill unit 110, so that the air compressor 150 may be replaced without replacing the dispenser 101, or alternatively to facilitate removal and connection to the refill unit 110. As described in more detail below, sanitary sealing may be used to isolate the air compressor 150 from the portions of the liquid pump 120 that contact liquid, so that the air compressor 150 mechanism does not contact liquid during operation of the foam dispenser system 100.

The housing 102 of the dispenser 101 further contains one or more actuating members 104 to activate the liquid pump 120 and air compressor 150. As used herein, actuator or actuating mechanism includes one or more parts that cause the dispenser 101 to move liquid, air or foam. Actuator 104 is generically illustrated because there are many different kinds of pump actuators which may be employed in the foam dispenser system 100. The actuator of the foam dispenser system 100 may be any type of actuator such as, for example, a manual lever, a manual pull bar, a manual push bar, a manual rotatable crank, an electrically activated actuator or other means for actuating the liquid pump 120 and air compressor 150 within the foam dispenser system 100. Electronic actuators may additionally include a sensor to provide for a hands-free dispenser system with touchless operation. Various intermediate linkages connect the actuator member 104 to the pump 120 and or air compressor 150 within the system housing 102.

The exemplary liquid pump 120 and air compressor 150 are horizontal pumps. That is, the pumps are actuated by a substantially horizontal movement. The external actuator 104 may be operated in any manner, so long as the intermediate linkages transform that motion to a substantially horizontal motion to activate the liquid pump 120 and air compressor 150. As illustrated, dispenser 101 includes a manual actuator lever 104 that is secured to housing 102 by a hinge 103. In one embodiment, actuator lever 104 includes a pivotal contact element 105 that contacts actuator arm 156 to activate the pump 120 and air compressor 150. Pump 120 includes a dispensing nozzle 122 which extends below the bottom of housing 102. In addition, a refill retaining bracket 180 is secured to housing 102. Refill retaining bracket 180 releasably retains the refill unit 110 in foam dispenser 101. Refill unit 110, including the liquid pump 120 and outlet nozzle 122 may be readily inserted and removed from foam dispenser 101 without removing the air compressor 150 from the foam dispenser. Accordingly, all of the elements that contact liquid, "wet parts," may be disposed of without the need to dispose of components that do not contact liquid.

Figure 2:
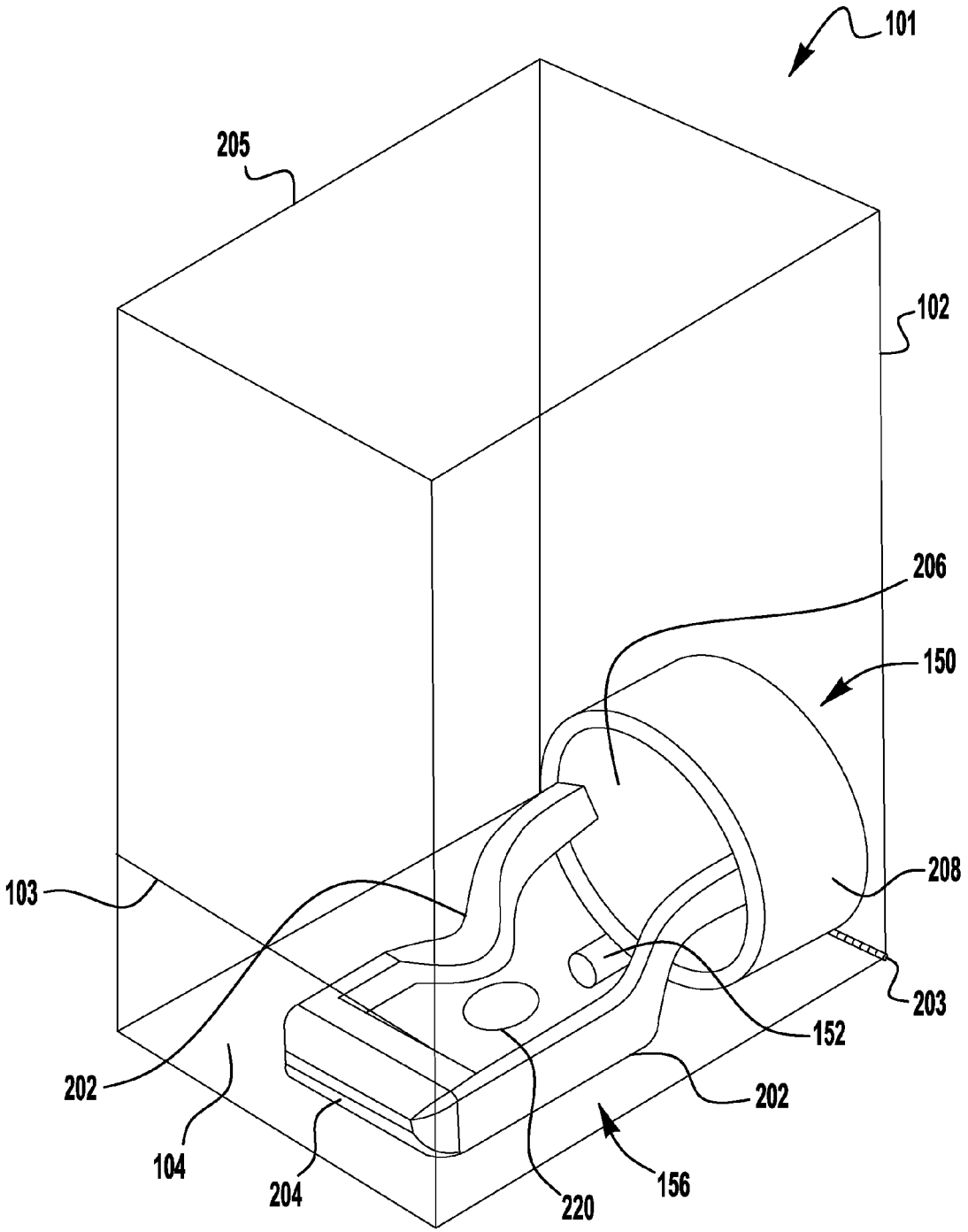
FIG. 2 illustrates a prospective view of the generic dispenser 101 having an air compressor 150 attached thereto.

FIG. 2 illustrates a prospective view of an embodiment of dispenser 101. Dispenser 101 includes a housing 102, which is illustrated as transparent for purposes of clarity. Housing 102 includes a front portion 205 that is attached by hinge 203. Front portion 205 of housing 102 rotates down to facilitate inserting a refill unit (not shown) into dispenser 101. As discussed with respect to FIG. 1, front portion 205 of housing 102 includes an actuator lever 104. Housing 102 includes an opening 220 in the bottom thereof which allows nozzle 122 to dispense foam to an object located below dispenser 101. Secured to housing 102 is air compressor 150.

In one embodiment, air compressor 150 includes a cylinder 208. Cylinder 208 includes a side wall and a bottom wall. A piston 206 fits within cylinder 208 and sealing member 401 (FIG. 4) creates a seal between the outside wall of piston 206 and the inside wall of cylinder 208. Secured to piston 206 is an actuator arm 156. Actuator arm 156 includes a pair of extensions 202, which are linked to cross member 204. Air compressor 150 also includes air compressor outlet 152 that releasably engages with liquid pump 120. In one embodiment, air compressor 150 includes an air inlet 404 (FIG. 4) and one-way air inlet valve 406. One-way air inlet valve 406 allows air to enter air compressor 150 to recharge the air chamber 410. In addition, in one embodiment, air compressor 150 includes a biasing member 402 to move the piston 206 to its outermost position and recharge the air chamber 410.

Figure 3:
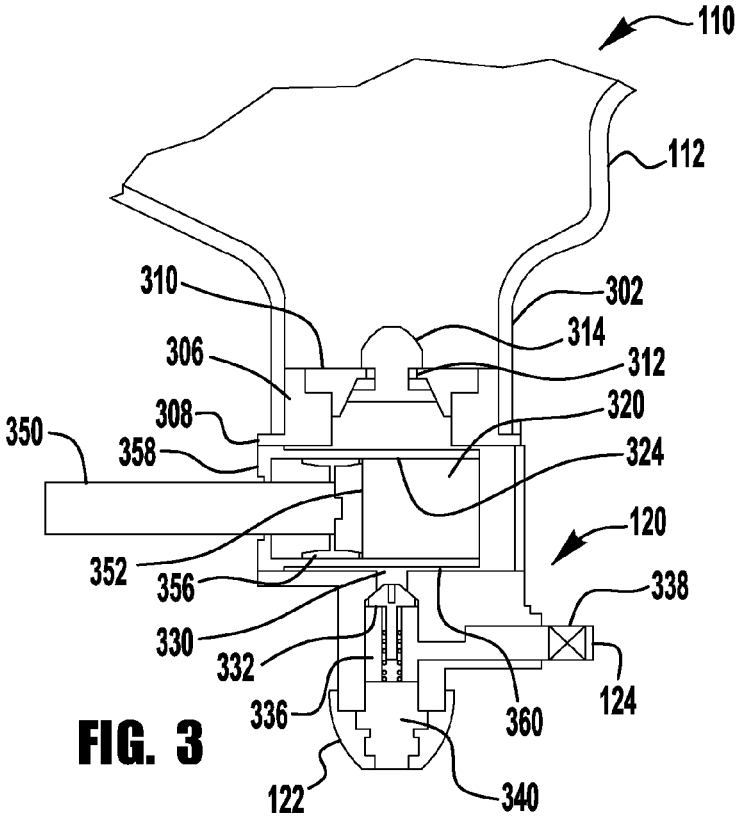
FIG. 3 illustrates a cross-section of an exemplary embodiment of a refill unit 110 for use in a dispenser system 100 showing a portion of a container 112 for holding a fluid and a liquid pump 120.

FIG. 3 illustrates a cross-section of an exemplary embodiment of a refill unit 110 that includes pump 120 and container 112. Container 112 includes a neck portion 302. Pump 120 is connected to the neck 302 of container 112 by a press fit connection. Optionally, a cap (not shown) may connect pump 120 to container 112. Still yet, other means such as, for example, a compression fit, welding, adhesive, friction fit, etc. may be used to join pump 120 with container 112.

Pump 120 includes a pump housing 306 that contains a liquid chamber 320. Pump housing 306 includes an inlet opening 312. A one-way liquid inlet valve 314 is located in the inlet opening 312. The upper portion of liquid inlet valve 314 includes slots (not shown) for liquid to pass through and flow into inlet opening 312. Optionally, additional liquid inlet openings may be provided. One-way liquid inlet valve 314 may be any type of valve such as, for example, a flapper valve, a conical valve, a plug valve, an umbrella valve, a duck-bill valve, a slit valve, a mushroom valve or the like. One-way liquid inlet valve 314 allows liquid to flow into liquid chamber 320 and prevents liquid from flowing out of liquid chamber 320 back into container 112. Pump housing 306 includes a liquid outlet opening 330 that has a one-way liquid outlet valve 332 associated therewith. One-way liquid outlet valve 332 may be any type of valve such as, for example, a flapper valve, a conical valve, a plug valve, an umbrella valve, a duck-bill valve, a slit valve or a mushroom valve, so long as it opens under pressure to allow liquid to exit the liquid chamber 320, but does not let air, liquid or foam enter the liquid chamber 320 through opening 330.

Located at least partially within liquid chamber 320 is a sleeve 324. The sleeve allows the pump housing 306 to be cheaply manufactured without tight tolerances and even have dips or recesses in the pump chamber. In some embodiments, the pump housing 306 has uneven cross-section, uneven fill. The sleeve is made with more precision and has tighter tolerances and is inserted into the pump chamber 320. A liquid tight seal prevents liquid from flowing out of liquid chamber 320 around sleeve 324 and out of pump 120 and secures sleeve 324 to pump housing 306. The liquid tight seal may be formed by having end cap 358 of sleeve 324 fit snuggly within liquid chamber 320 near the one end. End cap 358 seals the opening and retains piston 350. Optionally, end cap 358 may be secured to the housing 306 by an adhesive, by welding or the like.

A passageway 360 exists between the outside of sleeve 324 and the inside wall of liquid chamber 320. The passageway 360 allows liquid to flow into and out of the liquid chamber 320, which includes the interior of sleeve 324. Sleeve 324 may be cylindrical or may have outwardly extending ribs to engage the wall of the liquid chamber 320. Ribs (not shown) may facilitate the creation of multiple passageways 360 in the open areas created by the ribs.

Sleeve 324 allows inlet valve 314 and outlet valve 332 to be placed along any point of liquid chamber 320. Accordingly, the liquid inlet opening 312 and liquid outlet opening 330 may be advantageously positioned. In addition, piston head 352 may travel past inlet valve 314 and outlet valve 332. For example, in one embodiment, the liquid outlet opening 330 is located near the front of the refill unit 110 so that the foam may be dispensed at location that is further away from the back of the dispenser 100. In one embodiment, the liquid inlet opening 312 is located near the front of the refill unit 101. This flexibility allows the pump 120 to be easily modified for different applications. It also allows for flexibility in the design of the container 112. For example, the neck 302 of the container 112 may be located towards the front of the refill unit 110 rather than in the center of the refill unit 110. In some embodiments, the liquid inlet opening 312 and liquid outlet opening 330 are offset from one another. In one embodiment, the liquid outlet opening 330 is located closer to the front of the refill unit 110 than the liquid inlet opening 312. In one embodiment, sleeve 324 is not required; however, in that embodiment, the liquid inlet and liquid outlets are located so that the stroke of the piston 360 does not cause piston head 352 to pass the liquid inlet 312 and liquid outlet 330 during operation.

In the embodiment illustrated in FIG. 1 the inlet and outlet valves 314, 332 are aligned on a centerline of the container 112. In one embodiment, one or both of the inlet and outlet valves 314, 332 are located off of the centerline of the container 112. In another embodiment, both the inlet and outlet valves 314, 332 are located off of the centerline of the container 112. One or both may be located closer to the front of the container. In such embodiments, the neck 302 of the container 112 may also be offset from the centerline of the container 112. In one embodiment, the neck 302 of the container 112 is offset towards the front of the container. As used herein, "offset from the centerline of the container" means that the object is offset from at least one centerline, not necessarily from all potential centerlines of the container.

Pump 120 includes a liquid piston 350. Liquid piston 350 has a piston head 352 that has a liquid piston seal 356. Liquid piston seal 356 may be any type of seal such as, for example, a wiper seal, an o-ring, a gasket or the like. Liquid piston seal 356 engages the inside wall of sleeve 324. Preferably, liquid piston seal 356 has enough contact against sleeve 324 so that liquid does not pass by the seal, but the contact is limited so that less energy is necessary to move the piston 350. Pump 120 may include a biasing member (not shown) to move piston 350 outward when no horizontal force is being applied to the piston 350. Optionally, piston 350 may have an engagement member (not shown) that engages with actuator arm 156 to move piston 350 to its outermost position, when no force is being applied to the actuator arm 156.

Pump housing 306 includes mixing chamber 336 located downstream of outlet opening 330. As fluid passes by one-way outlet valve 332, it enters mixing chamber 336. Mixing chamber 336 includes an air inlet 124. In some embodiments, air inlet 124 includes a one-way valve 338. One-way valve 338 may be any type of one-way valve such as, for example, those identified above. One-way inlet valve 338 is a sanitary valve in that it prevents liquid or foam from traveling past and contaminating air compressor 150 or other parts that remain with the dispenser 101 when the refill unit 110 is removed from the dispenser 101. It is desirable to keep the parts that remain with the dispenser 101 free from contamination with the liquid or fluid to prevent bacteria from growing in the dispenser 101. Thus, a user need only replace the refill unit 110 including the wet parts without the need for replacing the air compressor 150.

In some embodiments, the air pump(s) or air compressor (s) disclosed herein include an air inlet having a one-way air inlet valve therethrough. The one-way air inlet valve allows air to enter the air pump to recharge the air pump. In some embodiments, the air inlet is located inside of the foam dispenser housing so that air from inside of the dispenser is used to feed the air pump. Using air from inside the dispenser may help to prevent moisture from entering the air pump through the air inlet and air inlet valve. In some embodiments, a vapor barrier is provided at the air inlet. A vapor barrier allows air to pass through the air inlet and enter the air pump, but prevents moisture from entering the air pump. A suitable vapor barrier is a woven one-way vapor barrier such as, for example, Gortex®, that is arranged so that vapor does not enter the air pump.

In some embodiments, the air pump(s) or air compressor (s) include an antimicrobial substance molded into their housing. One suitable antimicrobial substance contains silver ions and/or copper ions. A silver refractory, such as, for example, a glass, oxide or silver phosphate may be used. One suitable commercially available product is Ultra-Fresh, SA-18, available from Thomson Research Associates, Inc. Other suitable antimicrobial materials that may be used in the air pump include, but are not limited to Vinyzene™, available from the Dow Chemical Company, and Bisafe, a silane-based antimicrobial product available from the RTP Company. The antimicrobial substance prevents mold or bacteria from growing inside of the air pump or air compressor. Optionally, several different types of antimicrobial substances may be used alone or in combinations with other antimicrobial substances, such as for example, a combination of a leaching antimicrobial and a non-leaching antimicrobial. Suitable leaching antimicrobials may include, for example, silver, nanosilver or copper may be used. Suitable non-leaching antimicrobials include, for example, silver based and triclosan based antimicrobials. Silver, copper, combinations of silver and copper alone, combinations of silver, copper and other antimicrobials may be used. The use of the terms silver and copper used herein are not intended to limit the types of copper or silver to metal, and is intended to cover metal salts and other variants of copper and silver.

Downstream of mixing chamber 336 is a foaming cartridge 340. In one embodiment, foaming cartridge 340 has a housing with one or more screens located therein. Optionally, foaming cartridge 340 may be replaced with one or more screens, a sponge or other porous member. In addition, secured to pump housing 306 is outlet nozzle 122.

As can be seen from the Figures, pump 120 is compact. The narrower diameter of liquid chamber 320 is more efficient in that it takes less energy to move a given volume of fluid than a larger diameter liquid chamber having the same volume but a larger diameter. Using less energy allows for a longer battery life for an electronic dispenser. In addition, the compact profile reduces shipping costs. Further, the ability to reuse the air compressor provides sustainability and is "green" in that it reduces the amount of plastic that ends up in landfills.

Figure 4:
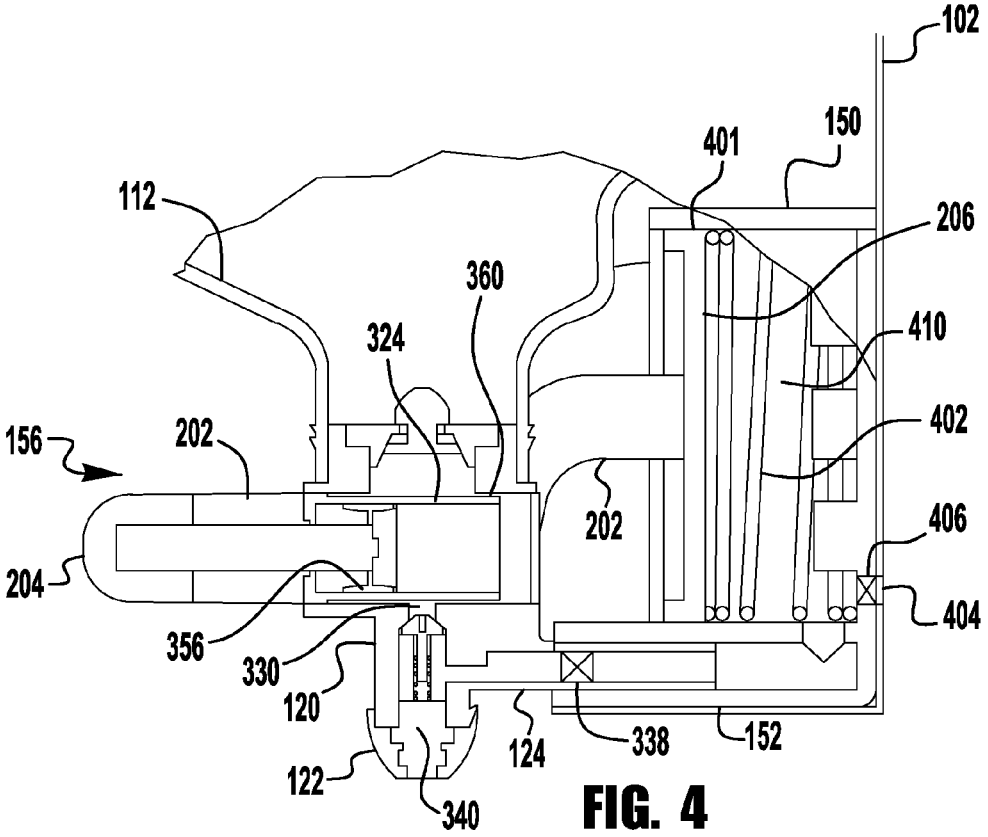
FIG. 4 illustrates a cross-section of an exemplary embodiment of a refill unit 110 installed in a dispenser 100 and mated with air compressor 150.

FIG. 4 illustrates refill unit 110 installed in dispenser housing 102 and pump 120 is releasably mated with air compressor 150. To install the refill unit 110, the dispenser housing 102 is opened up and the refill unit 110 is lowered downward. As the refill unit 110 is lowered, the liquid pump air inlet 124 aligns with the air compressor outlet 152. In one embodiment, as the two components align the refill unit 110 is pushed toward the back of the dispenser, the liquid pump air inlet 124 slides into air compressor outlet 152 and is snug enough to form a seal. In addition, piston 350 fits within actuator arm 156 so that cross member 204 will engage piston 350 when actuator lever 104 is moved horizontally.

During operation, the foam dispensing system 100 is activated by moving actuator lever 104. Actuator lever 104 causes liquid piston 350 and air piston 206 to move horizontally toward the rear of the foam dispensing system 100. Movement of liquid piston 350 horizontally reduces the volume of liquid chamber 320. Once the pressure is sufficient to overcome the cracking pressure of liquid outlet valve 332, the pressurized liquid flows through passage 360 through passage 330, past liquid outlet valve 332 and travels into mixing chamber 336. Movement of air piston 206 reduces the volume of the air chamber 410 and pressurizes the air in the air chamber 410. The pressurized air passes through air compressor outlet 152, past sanitary valve 338, through liquid pump air inlet 124 and mixes with the liquid in mixing chamber 336 to form a liquid/air mixture. The liquid/air mixture is forced through foaming cartridge 340 and is dispensed through nozzle 122 as a foam.

Upon release of actuator lever 104, the biasing member 402 in the air compressor 150 urges air piston 206 away from the rear of dispenser system 100 and expands the volume of air chamber 410. Sanitary valve 338 prevents air from entering the air chamber 410 through the air compressor outlet 152. Accordingly, air is drawn into air chamber 410 through air inlet 404 past one-way air inlet valve 406. In addition, liquid piston 330 is urged outward away from the rear of the dispenser system 100. As liquid piston 330 moves outward, liquid chamber 320 expands creating a vacuum. The vacuum pressure seals liquid outlet valve 330 and once the vacuum pressure is sufficient to overcome the cracking pressure of liquid inlet valve 314, liquid flows from container 112 past liquid inlet valve 314 through the passage 360 and into liquid chamber 320. The pump 120 and air compressor 150 are now primed and ready for the next dispense cycle.

Figure 5:
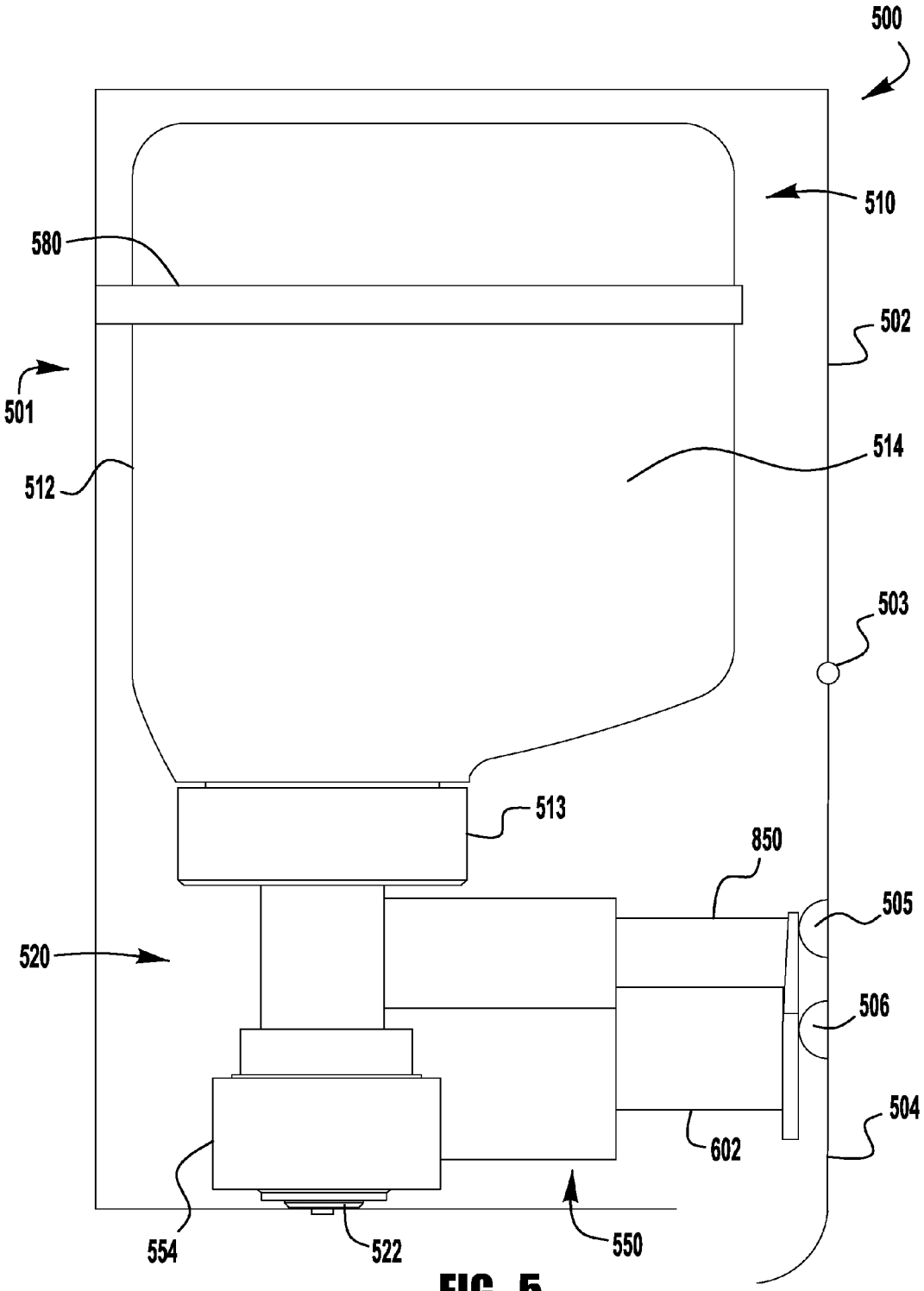
FIG. 5 illustrates another exemplary embodiment dispenser system 500 with a refill unit 510 installed therein.
Figure 8:
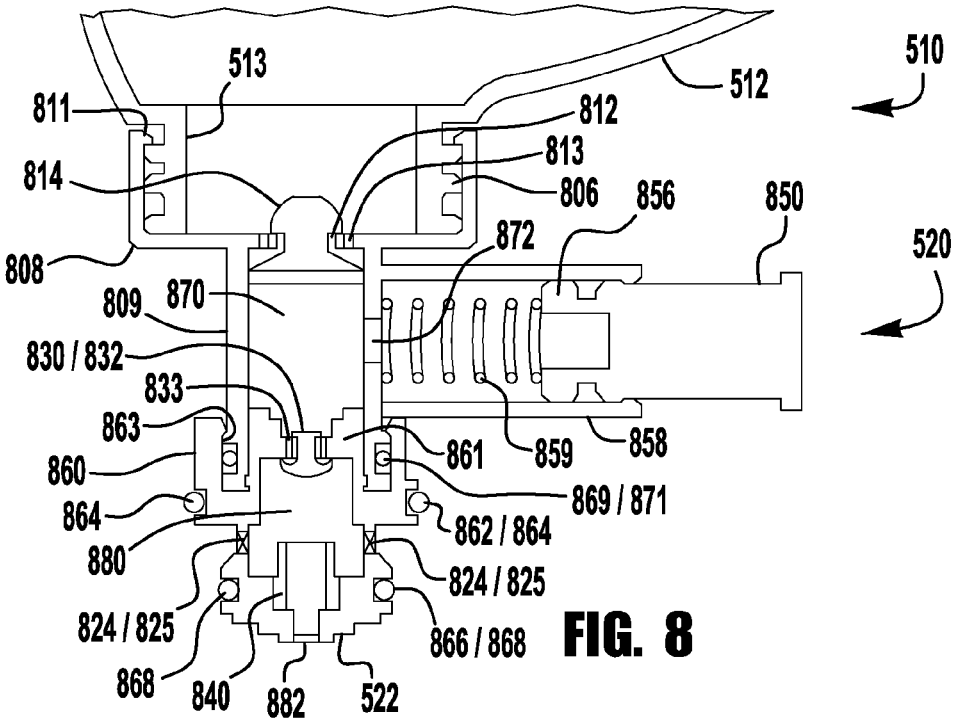
FIG. 8 illustrates a cross-section of an exemplary embodiment of a refill unit 510 including a container 512 and liquid pump 520.

FIG. 5 illustrates another exemplary embodiment of a foam dispensing system 500. Foam dispensing system 500 includes a disposable refill unit 510 for use in a foam dispenser 501. The disposable refill unit 510 includes a container 512 connected to a liquid pump 520. Liquid pump 520 includes an air inlet 824 (FIG. 8). The disposable refill unit 510 may be placed within a housing 502 of the dispenser 501 and releasably placed in fluid communication with an air compressor 550. The foam dispenser system 500 may be a wall-mounted system, a counter-mounted system, an un-mounted portable system movable from place to place or any other kind of foam dispenser system. Foam dispenser 501 includes an air compressor 550 secured thereto (see FIG. 6). Air compressor 550 may be permanently mounted to foam dispenser 501. Air compressor 550 includes a conduit or air passage 620 (FIG. 6), with an annular receptacle 554 for releasably connecting to the air inlet 824 of liquid pump 520. The releasable connection is achieved by sliding a portion of the liquid pump 520 into annular receptacle 554. Accordingly, refill unit 510 and pump 520 may be removed from dispenser housing 502 and discarded without removal of the air compressor 550. Air compressor 550 is a dual piston air compressor; however, the air compressor 550 may be any type of air compressor such as, for example, a bellows air compressor, a rotary air compressor, a piston air compressor, a fan, a compressor, a blower or the like. It may be a single air compressor or may be multiple air compressors.

The container 512 forms a liquid reservoir 514. The liquid reservoir 514 contains a supply of a foamable liquid within the disposable refill unit 510. In various embodiments, the contained liquid could be for example a soap, a sanitizer, a cleanser, a disinfectant or some other foamable liquid. In the exemplary disposable refill unit 510, the liquid reservoir 514 is formed by a collapsible container 512, such as a plastic container or a flexible bag-like container. In other embodiments, the liquid reservoir 514 may be formed by a rigid housing member, or have any other suitable configuration for containing the foamable liquid without leaking. The container 512 may advantageously be refillable, replaceable or both refillable and replaceable. In other embodiments, the container 512 may be neither refillable nor replaceable.

In the event the liquid stored in the reservoir 514 of the installed disposable refill unit 510 runs out, or the installed refill unit 510 otherwise has a failure, the installed refill unit 510 may be removed from the foam dispenser system 500. The empty or failed disposable refill unit 510 may then be replaced with a new disposable refill unit 510 including a liquid-filled reservoir 514. The air compressor 550 remains located within the foam dispenser 501 while the disposable refill unit 510 is replaced. In one embodiment, the air compressor 550 is also removable from the housing 502 of the dispenser 501, separately from the disposable refill unit 510, so that the air compressor 550 may be replaced without replacing the dispenser 501, or alternatively to facilitate removal and connection to the refill unit 510. Optionally, air compressor 550 may be mounted to the liquid pump 520 and disposed of along with the refill unit 510. As described in more detail below, sanitary sealing may be used to isolate the air compressor 550 from the portions of the liquid pump 520 that contact liquid, so that the air compressor 550 mechanism does not contact liquid during operation of the foam dispenser system 500.

The housing 502 of the dispenser 501 further contains one or more actuating members 504 to activate the pump 520 and air compressor 550. As used herein, actuator or actuating mechanism includes one or more parts that cause the dispenser 501 to move liquid, air or foam. There are many different kinds of pump actuators which may be employed in the foam dispenser system 500 such as, for example, a manual lever, a manual pull bar, a manual push bar, a manual rotatable crank, an electrically activated actuator or other means for actuating the liquid pump 520 and air compressor 550 within the foam dispenser system 500. Electronic pump actuators may additionally include a sensor to provide for a hands-free dispenser system with touchless operation. Various intermediate linkages connect an actuator member to the pump 520 within the system housing 502.

The exemplary liquid pump 520 and air compressor 550 are horizontal pumps. That is, they are actuated by a substantially horizontal movement. The external actuator 504 may be operated in any manner, so long as the intermediate linkages transform that motion to a substantially horizontal motion on the liquid piston 850 and air piston 606. Dispenser 501 includes a manual actuator lever 504 that is secured to housing 502 by a hinge 503. In one embodiment, actuator lever 504 includes pivotal contact elements 505, 506 that contact pistons 602 and 850 respectively to activate the pump 520 and air compressor 550. Pump 520 includes a dispensing nozzle 522 which extends below the bottom of housing 502. In addition, a refill retaining bracket 580 is secured to housing 502. Refill retaining bracket 580 releasably retains the refill unit 510 in foam dispenser 501. Refill unit 510, including the liquid pump 520 and outlet nozzle 522, may be readily inserted by lowering refill unit 510 into dispenser 501 and removed from foam dispenser 501 by lifting upward without removing the air compressor 550 from the foam dispenser.

Figure 6:
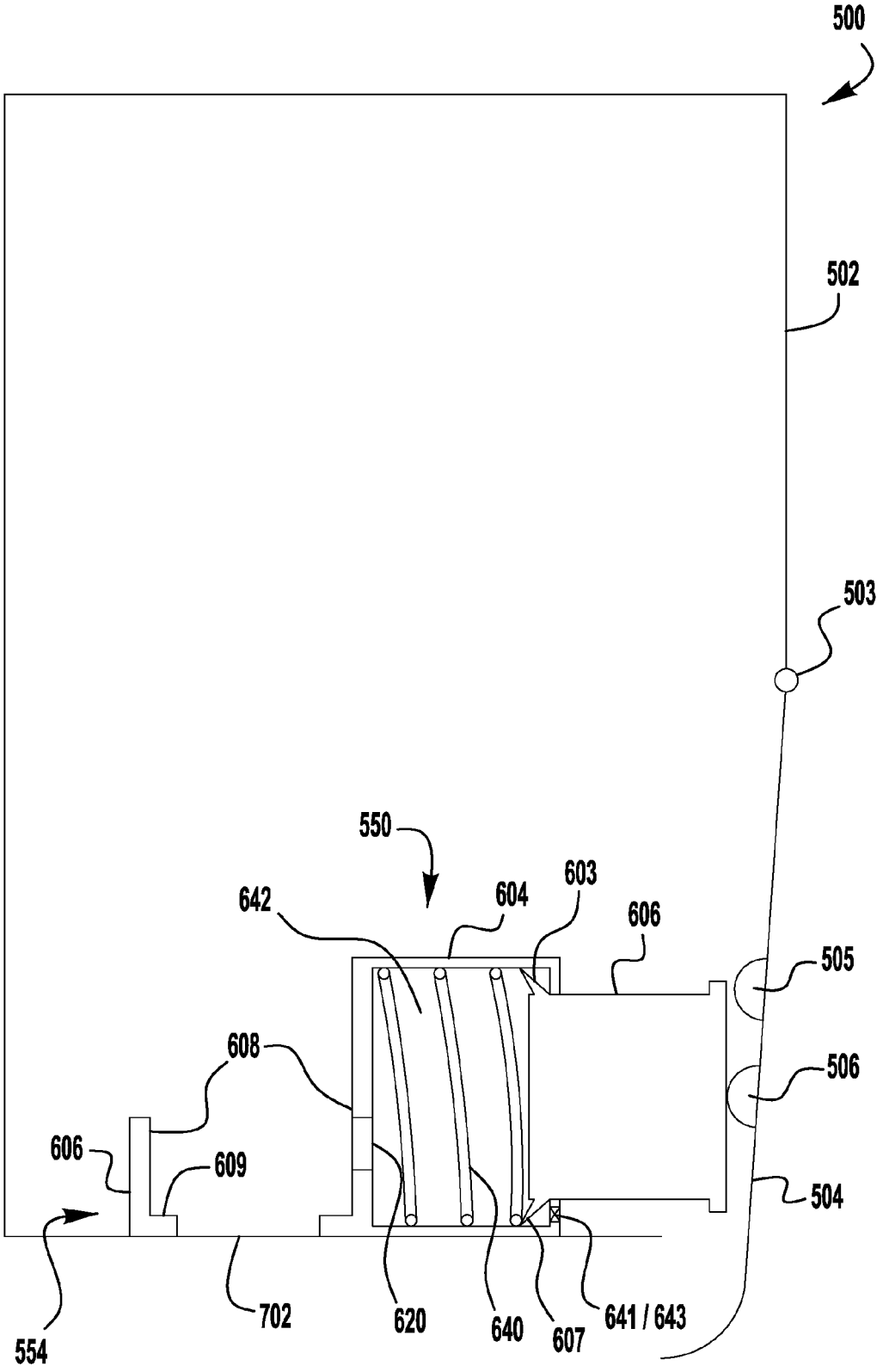
FIG. 6 illustrates a cross-section of an exemplary embodiment of the dispenser 500 for use in a dispenser system 500 that includes an air compressor 550 secured thereto.
Figure 7:
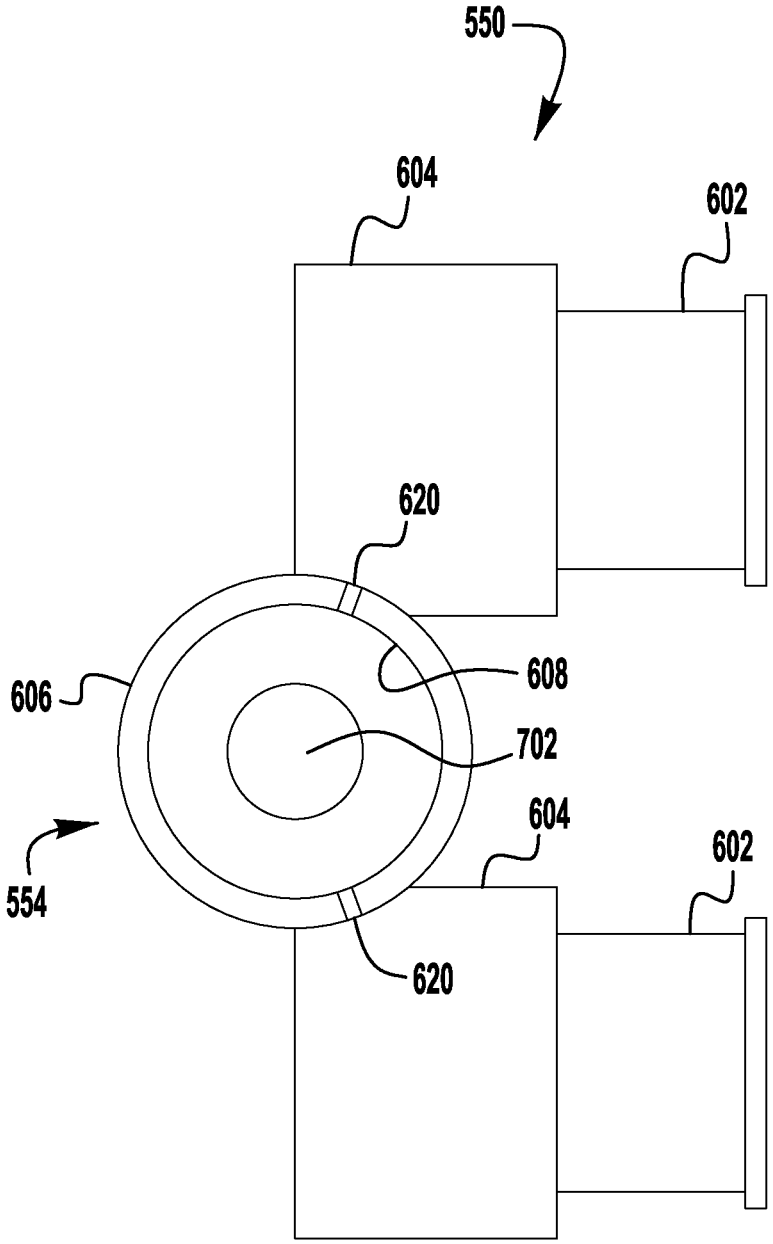
FIG. 7 illustrates a plan view of an exemplary embodiment of an air compressor 550 for use in a dispenser system 500.

FIG. 6 illustrates a cross-section of the exemplary embodiment of foam dispenser 501 without a refill unit. Foam dispenser 501 includes housing 502, actuator lever 504, liquid piston pivotal contact element 505, air piston pivotal contact element 506 and air compressor 550 as discussed above. Air compressor 550 is secured to housing 502. Air compressor 550 is best understood with respect to FIGS. 6 and 7. Air compressor 550 includes a pair of a cylindrical housings 604. Pistons 602 move reciprocally within piston housings 604. Pistons 602 include sealing members 603 that form a seal between pistons 602 and piston housings 604. In one embodiment, biasing members 640 such as, for example, springs are located within cylindrical housings 604 to urge pistons 602 to their outermost positions. Cylindrical housings 604 include air outlets 620 and air inlets 641. One-way air inlet valves 643 are included in air inlets 641 to allow air into the cylindrical housings 604 but prevent air from exiting through air inlets 641. Air outlets 620 enter into annular receptacle 554. Annular receptacle 554 has an outside wall 606, an inside wall 608 and a base 609. An opening 702 is provided in base 609 to allow the outlet nozzle 522 of liquid pump 550 to pass through when the refill unit 510 is installed in dispenser 501.

FIG. 8 is a cross-sectional view of the exemplary embodiment of a refill unit 510. Refill unit 510 includes a container 512 and liquid pump 520 secured thereto. Container 512 includes a neck portion 513 with annular projections 806. Liquid pump 520 includes pump housing connector 808. Pump housing connector 808 includes an annular projection 811 that mates with the annular projections 806 to connect pump 520 to container 512. Other types of connections may be used such, for example, as a press-fit connection, a welded connection, an adhesive connection, a threaded connection or the like. In addition, a sealing member (not shown) may be included between pump housing connector 808 and neck 513 to ensure a liquid tight connection between pump 520 and container 512.

Pump housing connector 808 is secured to pump housing 809. Pump housing 809 may be a separate part from pump housing connector 808 or they may be integrally formed. Pump housing 809 includes an aperture 812 that has a one-way inlet valve 814 secured thereto. In one embodiment, one or more liquid inlet apertures 813 are provided to allow liquid to flow from container 512 to liquid chamber 870. Optionally, the liquid may enter through aperture 812. One-way liquid inlet valve 814 may be any type of valve, such as for example, a flapper valve, a conical valve, a plug valve, an umbrella valve, a duck-bill valve, a slit valve or a mushroom valve so long as it allows liquid to enter liquid chamber 870 but prevents liquid from flowing from liquid chamber 870 back into container 512.

Pump housing 809 includes an opening 872 through a sidewall. Opening 872 leads to the interior of piston housing 858. Piston housing 858 is a cylindrical housing that receives liquid piston 850. Liquid piston 850 reciprocates back and forth in piston housing 858. Piston 850 includes a seal 856. Seal 856 may be any type of suitable seal such as, for example, a wiper seal, one or more o-rings or the like. A biasing member 859 such as, for example a spring may be included within piston housing 858 to urge piston 850 to its outermost position to expand the volume of liquid chamber 870.

Pump housing 809 includes connector 863. Connector 863 mates with nozzle housing 860 to join the two together with a snap-fit connection. Other suitable types of connections may be used such as, for example, a press-fit connection, an adhesive connection or the like. Nozzle housing 860 includes a projecting member 861 that extends up into the interior of pump housing 809. The connection between pump housing 809 and nozzle housing 860 is a liquid tight connection, which is facilitated by annular groove 869 and sealing member 871. Nozzle housing 860 includes an aperture 830 therethrough with a one-way outlet valve 832 positioned therein. One-way outlet valve 832 may be any type of valve such as, for example, a flapper valve, a conical valve, a plug valve, an umbrella valve, a duck-bill valve, a slit valve or a mushroom valve. One or more apertures 833 allow liquid to pass through and into mixing chamber 880 located in nozzle housing 860. Optionally, liquid may flow through aperture 830. One-way outlet valve 832 allows liquid to exit liquid chamber 870 and flow into mixing chamber 880 located in outlet nozzle housing 860 but prevents liquid, foam or air from moving from the mixing chamber 880 into liquid chamber 870. Downstream of mixing chamber 880 is a foaming cartridge 840. Foaming cartridge 840 may be include one or more screens, a sponge or other obstructions to create a turbulent pathway through outlet nozzle housing 860 to cause the liquid and air mixture to form a rich foam. In one embodiment, foaming cartridge 840 contains two or more screens. Downstream of foaming cartridge 840 is outlet nozzle 882.

Figure 9:
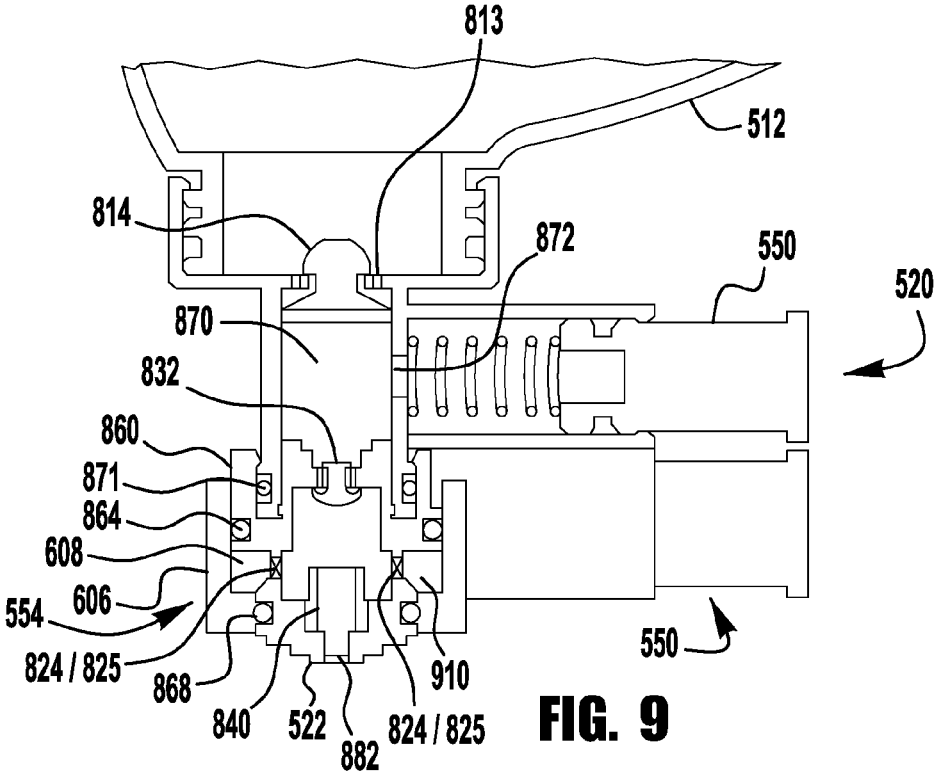
FIG. 9 illustrates a cross-section of an exemplary embodiment of the refill unit 510 installed in a dispenser 501 mated with air compressor 550.

Nozzle housing 860 includes one or more openings 824 that lead from outside of the nozzle housing 860 into the mixing chamber 880. One-way valve(s) 825 are located proximate opening(s) 824 to provide a sanitary seal between liquid pump 520 and air compressor 550 when the refill unit 510 is installed in dispenser 501 (FIG. 9). One-way valve 825 may be any type of valve such as, for example, a flapper valve, a conical valve, a plug valve, an umbrella valve, a duck-bill valve, a slit valve, a mushroom valve or the like. One-way valve 825 prevents liquid and foam from coming in contact with the air compressor 550 or other components that are not replaced with refill unit 510.

Nozzle housing 860 includes a pair of annular grooves 862 and 866. A pair of sealing members, such as, for example, o-rings 864 and 868 are located within grooves 862, 866 respectively. The o-rings 864, 868 form a seal with annular receptacle 554 when the refill unit 510 is placed in foam dispenser 501. The o-rings 864, 868 seal against inside wall 608 (FIG. 6) of annular receptacle 554 and form an air passageway 910 that places the liquid pump 520 in fluid communication with air compressor 550 when the refill unit 510 is inserted into foam dispenser 501. Optionally, o-rings 864, 868 may be another type of sealing member, such as, for example, a wiper seal, foam strip or the like.

Foam dispenser 501 may be permanently or semi-permanently installed in a desired location. Refill unit 510 is placed inside of dispenser 501 so that nozzle housing 860 fits within annular receptacle 554 so that sealing members 864, 868 form a sealed air passageway 910 to place the mixing chamber 880 of nozzle housing 860 in fluid communication with air compressor 550. One or more brackets 580 may be used to retain refill unit 510 in dispenser 501. The refill unit 510 is removed from dispenser 501 by releasing bracket 580, or by lifting refill unit 510 upward.

During operation, the foam dispensing system 500 is activated by pushing actuator lever 504 which moves liquid piston 850 and air pistons 602 horizontally toward the back of the dispenser. Movement of liquid piston 850 horizontally reduces the volume of liquid chamber 870. Once the pressure is sufficient to overcome the cracking pressure of liquid outlet valve 832, the liquid flows out of the liquid chamber 870 and travels into mixing chamber 880. Movement of air piston 602 reduces the volume of air chamber 642 and pressurizes the air in the air chamber 642. The pressurized air passes through air compressor outlet 620 into passageway 910 and into liquid pump air inlet 824 past sanitary valve 825 and mixes with the liquid in mixing chamber 880 to form a liquid/air mixture. The liquid air mixture is forced through foaming cartridge 840 and is dispensed through nozzle 522 as a foam.

Upon release of actuator lever 404, the biasing member 840 in the air compressor 550 urges air pistons 602 away from the rear of dispenser system 500 and expands the volume of air chamber 642. Sanitary valve 825 prevents air from entering the air chamber 642 through the air compressor outlet 620, and air is drawn into air chamber 642 through air inlet 641 past one-way air inlet valve 643. In addition, liquid piston 850 is urged outward away from the rear of the dispenser system 500. As liquid piston 850 moves outward, liquid chamber 870 expands creating a vacuum. The vacuum pressure seals liquid outlet valve 832 and once the vacuum pressure is sufficient to overcome the cracking pressure of liquid inlet valve 814, liquid flows from container 512 past liquid inlet valve 814 into liquid chamber 870. The pump 520 and air compressor 550 are now primed and ready for the next dispense cycle.

Figure 10:
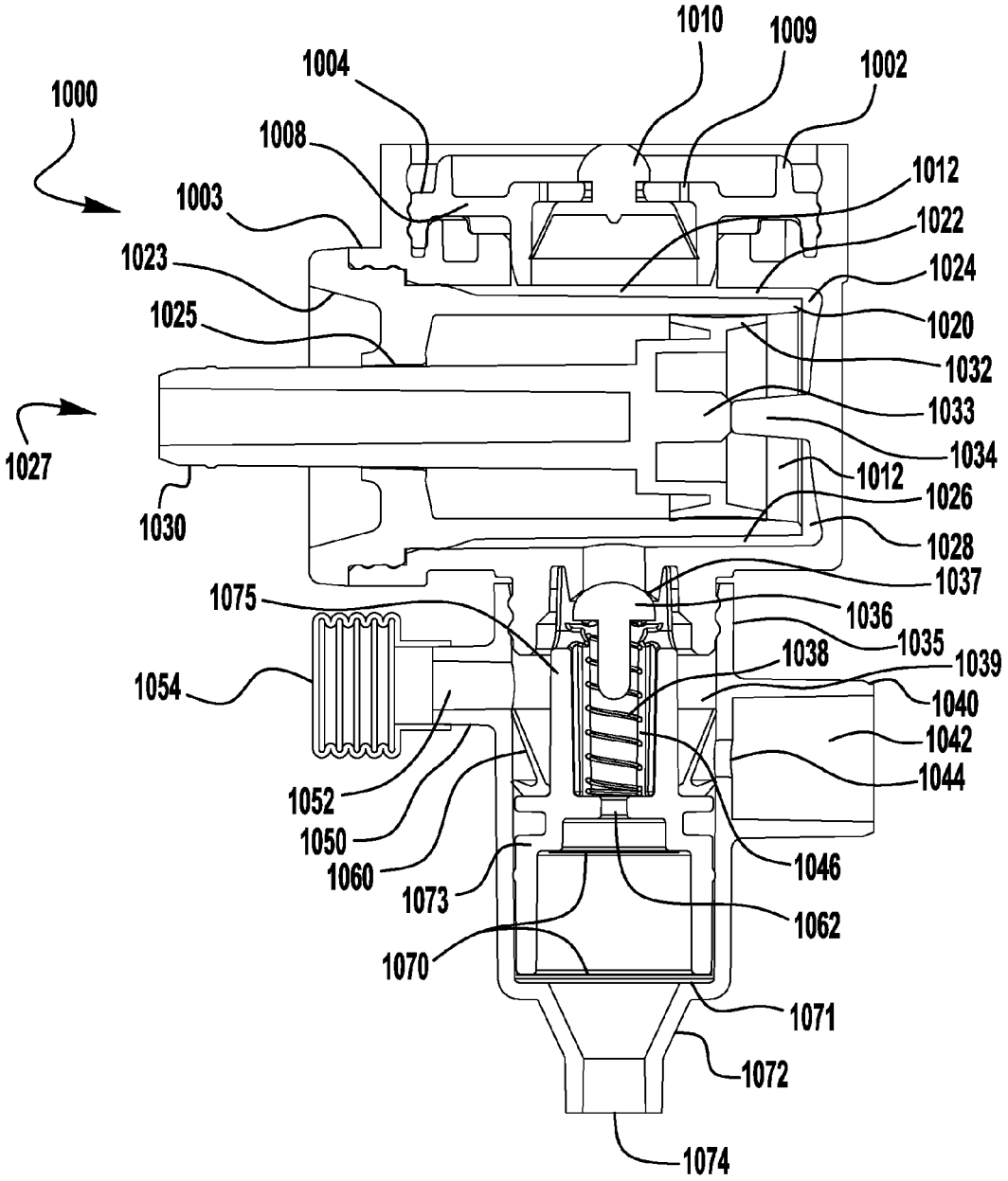
FIG. 10 illustrates a cross-section of an exemplary embodiment of a pump 1000 for use in a refill unit of a foam dispenser in a discharged position.
Figure 11:
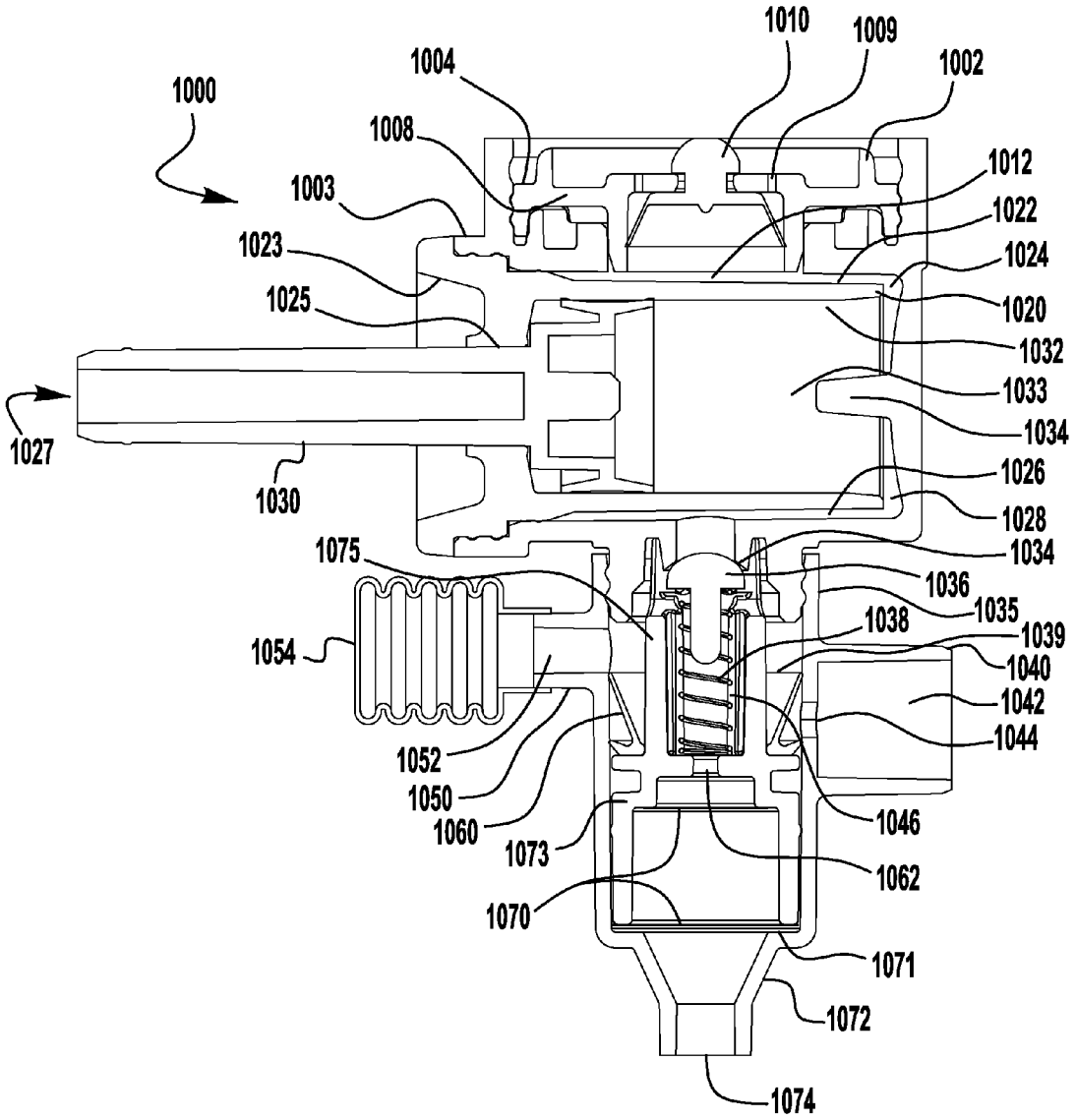
FIG. 11 illustrates a cross-section of the exemplary embodiment of a pump 1000 for use in a refill unit of a foam dispenser in a charged position.

FIGS. 10 and 11 are a cross-sectional view of an exemplary embodiment of a pump 1000 suitable for use in foam dispensers and refill units for foam dispensers. Pump 1000 includes a housing 1002. Housing 1002 receives inlet plate 1008. Inlet plate 1008 includes a annular projection 1006. A neck of a container (not shown) is received within an annular groove 1004 formed between annular projection 1006 and housing 1002. Housing 1002 may be connected to the container by any means such as, for example, a threaded connection, a welded connection, an adhesive connection or the like. Optionally, a gasket may fit in annular groove 1004 to help form a liquid tight seal with the container. Inlet plate 1008 may be integrally formed with housing 1002. Inlet plate 1008 includes one or more inlet apertures 1009 located therethrough. In addition one-way inlet valve 1010 is secured to inlet plate 1008. One-way inlet valve 1010 may be any type of one-way valve such as, for example, a ball and spring, a poppet valve, a flapper valve, an umbrella valve, a slit valve or the like.

Pump housing 1002 includes a liquid chamber 1012. In one embodiment, liquid chamber 1012 is cylindrical. Located within liquid chamber 1012 is a sleeve 1020. Housing 1002 includes an annular projection 1003 at one end of the liquid chamber 1012. Sleeve 1020 is secured to annular projection 1003 by collar 1023. Collar 1023 includes an aperture 1025. Piston 1027 includes a shaft 1030 that projects through aperture 1025. Piston 1027 is slideable in a reciprocating manner within sleeve 1020. Piston 1027 includes a double wiper seal 1032 located at one end. Movement of piston 1027 causes the volume of liquid chamber 1012 to expand and contract. Double wiper seal 1032 may be replaced with any type of sealing member such as, for example, an o-ring, a single wiper seal or the like. Housing 1002 includes a projecting member 1034 that contacts an end 1033 of piston 1027 to stop movement of piston 1027 when it reaches the end of its stroke.

An inlet passageway 1022 is formed between sleeve 1020 and the wall of liquid chamber 1012. The inlet passageway 1022 may extend entirely around sleeve 1020 or may be enclosed by one or more rib projections (not shown) that cause liquid in inlet passageway 1022 to flow through passage 1024 into the interior of sleeve 1020. An outlet passageway 1026 also exists between sleeve 1020 and liquid chamber 1012. The outlet passageway 1026 may extend entirely around sleeve 1020 or may be enclosed by one or more rib projections that cause liquid to flow through passage 1028 from the interior of sleeve 1020. Passageway 1022 and passageway 1026 may be a common passageway.

Housing 1002 includes valve seat 1037. Connected to housing 1002 is lower housing 1035. Lower housing 1035 may be connected to housing 1002 by any means such as, for example, a threaded connection, a snap-fit connection, a welded connection, an adhesive connection or the like. Lower housing 1035 has an interior cavity 1039. Lower housing 1035 also includes a first annular projection 1040 that forms an air inlet 1042. An aperture 1044 connects air inlet to cavity 1039. Annular projection 1040 may be releasably connected to an air source that is permanently connected to a foam dispenser (not shown). The releasable connection may be made by any means such as, for example, a snap-fit, friction fit, a tube (not shown) that slides over or into annular projection 1040.

Lower housing 1035 also includes a second annular projection 1050 that has a passageway 1052 connecting to cavity 1039. A compressible chamber such as, for example, air bellows 1054 is connected to annular projection 1050 by any means such as, for example, a friction fit, a snap fit, a welded connection, an adhesive connection or the like. Lower housing 1002 includes a floor 1071. A tapered section 1072 extends from floor 1071 to annular outlet 1074.

Located within cavity 1039 is an insert 1073. Insert 1073 may be made of one or more components. Insert 1073 includes an interior cavity 1046 formed by annular member 1075. Interior cavity 1046 retains one-way outlet valve 1036 and biasing member 1038. One-way outlet valve seals against valve seat 1037. One-way outlet valve 1036 may be any type of one-way valve such as, for example, a ball and spring valve, a poppet valve, a flap valve, an umbrella valve, a slit valve or the like. In addition, insert 1073 contains a sanitary seal 1060. Sanitary seal 1060 is a flexible member that forms a one-way valve that allows air to enter from passageway 1042 and into the upper portion of cavity 1039 but prevents liquid or foam from flowing back into passageway 1042. In one embodiment, sanitary valve 1060 is integrally formed with insert 1073. Sanitary valve 1060 is a sanitary valve because it prevents liquid and foam from traveling into components of the foam dispenser that are not discarded with the refill unit that includes pump 1000. Insert 1073 includes foaming media 1070 secured therein. Foaming media 1070 may be one or more screens, porous members, baffles, a sponge, a foaming cartridge or the like. Foaming media 1070 may be an integral part with insert 1073 or may be a separate part.

An exemplary benefit to using sleeve 1020 is that the liquid inlet and/or inlet valve 1010 may be positioned over any portion of the sleeve without affecting the volume of liquid chamber 1012 or reducing the efficiency of pump 1000. Similarly, the liquid outlet and/or liquid outlet valve 1036 may be located along any portion of the sleeve without reducing the volume of liquid chamber 1012 or reducing the efficiency of pump 1000. In some embodiments, the liquid inlet and the liquid outlet are offset from one another. In some embodiments, the liquid outlet is located closer to the front of a dispenser than the liquid inlet when the pump 1000 is installed in the foam pump. In some embodiments, the liquid inlet and liquid outlet are along a common axis. The liquid piston 1027 may moved along a pump axis that is substantially horizontal. In some embodiments, the liquid inlet valve 1010 moves along an axis that is substantially normal to the pump axis. In some embodiments, a portion of the liquid inlet valve 1010 moves along a substantial vertical axis, such as the inlet valve 1010 illustrated in FIGS. 10 and 11, which may collapse both horizontally and vertically.

In addition, although the pump 1000 has been described as being made of selected sub-parts, pump 1000, as well as the other embodiments of pumps disclosed herein, may be made from more sub-parts or fewer sub-parts.

FIG. 10 illustrates pump 1000 in a fully discharged position. FIG. 11 illustrates pump 1000 in a charged or primed state. During operation, as piston 1027 of pump 1000 moves from the discharged position illustrated in FIG. 10 to the charged or primed state illustrated in FIG. 11, liquid flows in through liquid inlets 1009 into liquid chamber 1012 and through passageways 1022, 1024 into the interior of sleeve 1020. Simultaneously, bellows 1054 moves from a contracted position to an expanded position. Movement of bellows 1054 to an expanded position draws air in through the outlet 1074 and sucks back any residual fluid and foam to prevent fluid from leaking out of the outlet 1074 after the dispense cycle.

Movement of piston 1074 from the charged position illustrated in FIG. 11 to the discharged position illustrated in FIG. 10 causes fluid to flow out of the liquid chamber 1012 (including the center of the sleeve 1020) through passageways 1028, 1026 past liquid outlet valve 1036 into mixing chamber 1046. Simultaneously, bellows 1054 is collapsed forcing any liquid drawn in during the "suck back" operation into cavity 1039. In addition, air from an air source (not shown) flows through air passage 1042, through aperture 1044, past sanitary valve 1060, up around the top of member 1075 and into mixing chamber 1046 where it mixes with the incoming liquid. The air and liquid mixture is forced through aperture 1062 and through foam media 1070 to create a rich foam. The rich foam travels through tapered section 1072 where it accelerates due to the reduced volume and exits foam pump 1000 through outlet 1074.

Figure 12:
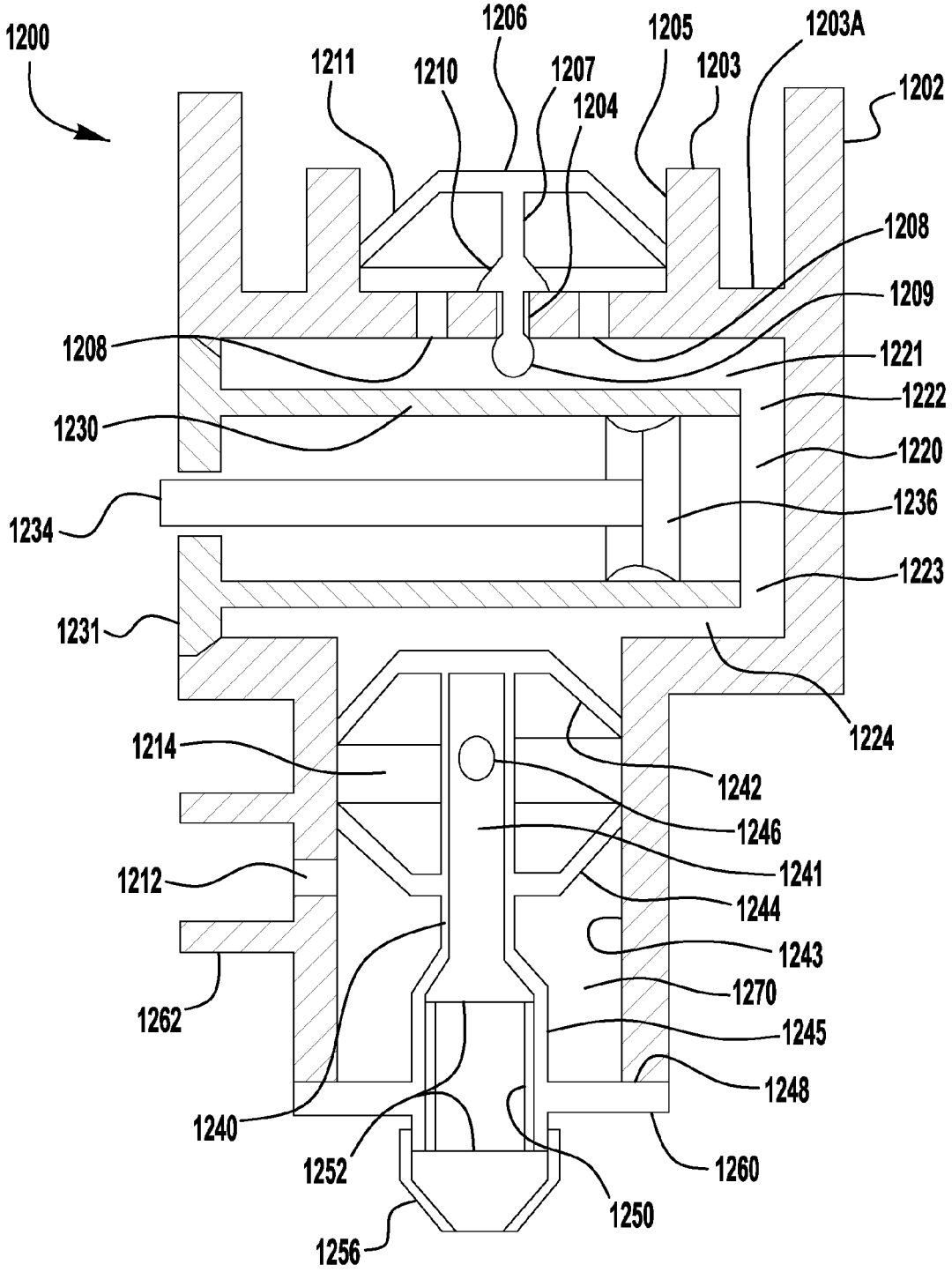
FIG. 12 illustrates a cross-section of another exemplary pump 1200.

FIG. 12 illustrates yet another exemplary embodiment of a horizontal pump 1200. As with all the exemplary pumps disclosed herein, pump 1200 may be used with many different types of the containers or dispensers including the ones disclosed herein. Pump 1200 includes a housing 1202. Housing 1202 includes annular projection 1203 that together with the upper portion of housing 1202 forms an annular groove 1203A that receives a container (not shown). Pump 1200 may be connected to the container by any means such as, for example, a threaded connection, an adhesive connection, a friction fit, a welded connection or the like. In addition, a gasket (not shown) may be used to create a liquid tight seal between a container and pump 1200.

Housing 1202 includes an aperture 1204 through the housing 1202 into pump chamber 1220. In addition, one or more liquid inlet apertures 1208 are included through housing 1202. A one-way check valve 1206 allows fluid to enter pump chamber 1220 from a container (not shown) and prevents fluid from exiting pump chamber 1220 and flowing back into the container. One-way check valve 1206 includes a stem 1207. Stem 1207 has a projecting member 1209 located at one end. Projecting member 1209 may be a spherical projection as shown, or may be a projection with a lower profile. Projection 1209 is pushed through aperture 1204 and expands once it passes through the aperture 1204 to retain one-way valve 1206 in place. Optionally, a second projecting member 1210 is also located along the stem 1207. Second projecting member 1210 contacts a surface of housing 1202 and also helps to keep one-way valve 1206 in place. One-way valve 1206 includes sealing member 1211. Sealing member 1211 has a conical shape and is resilient. In one embodiment, one-way valve 1206 is formed of a unitary resilient piece. During operation, sealing member 1211 is configured to deflect to allow liquid under pressure to pass from a container into the pump chamber 1220. When liquid chamber 1220 is pressurized, sealing member 1211 contacts surface 1205 of annular projection 1203 and forms a seal preventing liquid from flowing from pump chamber 1220 past sealing member 1211.

A unique feature about one-way liquid inlet valve 1206 is that one-way liquid inlet valve 1206 may be secured to pump housing 1202 from outside of the pump. Current liquid inlet valves are connected to the pump housing from the inside the pump housing. In addition, the arrangement shown and described herein of having the sealing member 1211 of the one-way liquid inlet valve located above the liquid inlet apertures 1208 and outside of the pump chamber 1220 is advantageous in that the portion of one-way valve 1206 located inside of the pump chamber 1220 may be reduced.

Optionally, other types of one-way check valves may be used such as, for example, a flap valve, a poppet valve, an umbrella valve, a spring and ball valve or any other valve that allows fluid to flow into pump chamber 1220 and prevents fluid from flowing from the pump chamber 1220 back into the container (not shown). However, these valves would be secured to the pump housing from inside the pump housing.

Located at least partially within pump chamber 1220 is a sleeve 1230. Sleeve 1230 fits within pump chamber 1220 and creates one or more passageways between the outside wall of the sleeve 1230 and one or more walls of the pump chamber 1220. The passageways may be similar to those described with respect to the pumps disclosed in FIGS. 3, 4, 10 and 11. Sleeve 1230 is secured to housing 1202 by a collar or end cap 1231. Collar 1231 may be press-fit into housing 1202, secured with an adhesive, connected by a threaded connection, or the like.

A piston head 1236 is secured to piston rod 1234 and is movable in a reciprocating fashion within sleeve 1230 to expand and contract the pump chamber 1220. As discussed above in more detail, benefits to having the sleeve 1230 is that the inlet to the pump chamber 1220 and the outlet from the pump chamber 1220 may be located anywhere along the length of the pump chamber 1220, or sleeve 1230. For example, in some embodiments, the liquid inlet and liquid outlet are offset from one another. In one embodiment, the liquid outlet is located farther away from the back of a dispenser when the pump 1220 is used in a dispenser. Although they are only off-set slightly in the embodiment illustrated in FIG. 12, the center of the liquid inlet valve being off-set from the center of the liquid outlet valve. In some embodiments, the center of the valves are well off-set.

Housing 1202 includes a cavity 1270. A portion of cavity 1270 forms mixing chamber 1214. An air inlet 1212 is located in a side wall of the cavity 1270. An annular projection 1262 extends outward and surrounds air inlet 1212. Annular projection 1262 forms a means for connecting pump 1200 with an air source (not shown) for providing air to pump 1200 to mix with the liquid to form a foam. The air source may be an air compressor permanently attached to the pump 1200 or may be an air source that is releasably connected to pump 1200. The air source may be a positive displacement air pump, a bellows pump, a piston pump, a fan, an air compressor or the like.

Located within cavity 1270 is dual action valve 1240. Dual action valve 1240 has a first wiper seal 1242 and a second wiper seal 1244, both of which are flexible. The first and second wiper seals 1242, 1244 also form part of the mixing chamber 1214, which is located between them. First wiper seal 1242 is a one-way liquid inlet valve which allows liquid under pressure to enter mixing chamber 1214. Second wiper seal 1244 is a one-way air inlet valve that allows air to enter mixing chamber 1214 and prevents liquid or air from traveling from the mixing chamber 1214 back toward the air source (not shown). Dual action valve 1240 includes an internal passage 1241. An aperture 1246 through the wall of the dual action valve 1240 allows the mixture of liquid and air to travel from the mixing chamber into passage 1241. The lower end of dual action valve 1240 has a flared portion 1245 proximate the outlet 1256. In addition, dual action valve 1240 includes an annular projection member 1260. Annular projection member 1260 is secured to the surface 1248 of housing 1202. Annular projection member 1260 may be secured to surface 1248 with an adhesive, a friction fit, a welded connection or the like. In one embodiment, dual action valve 1240 is a single piece construction. In some embodiments, one or more of the components of the dual action valve 1240 may be separate parts.

A foaming cartridge 1250 fits within the flared portion 1245 of dual action valve 1240. In one embodiment, foaming cartridge 1250 includes screens 1252. Screens 1252 may be individually secured in the flared portion 1245 without being connected to a cartridge. Optionally, foaming cartridge 1250 may simply be a porous member or a series of baffles.

During operation, piston head 1234 is moved outward toward the front of pump chamber 1220 which expands pump chamber 1220 creating a vacuum which causes one-way liquid outlet valve 1242 to seal against surface 1243. Liquid flows from the container (not shown) and into pump chamber 1220 past one-way liquid inlet valve 1206. The fluid flows around sleeve 1230 along channels 1221 and 1222 and into the interior of the sleeve 1230.

As the piston head 1234 moves inward toward the back of pump chamber 1220, the volume of pump chamber 1220 is reduced. The pressure created by the contracting pump chamber 1220 forces one-way liquid inlet valve 1206 to close by sealing off against surface 1205. Liquid travels past wiper seal 1242 into mixing chamber 1214. Air travels from an air source (not shown) that connects to member 1262 through aperture 1212 into cavity 1270 past wiper seal 1244 and into mixing chamber 1214 where the air mixes with the liquid to form an air/liquid mixture. The liquid and air may simultaneously enter mixing chamber 1214. Optionally, the timing may be slightly offset, wherein liquid starts entering the chamber slightly prior to the air, or in one embodiment, the liquid enters mixing chamber prior to the air entering the mixing chamber. The liquid/air mixture is forced by the air pressure through aperture 1246 into passage 1241, through foaming cartridge 1250 and is dispensed out of outlet nozzle 1256 as a foam.

The air compressors and liquid pumps described herein may include biasing members to return them to a first state, or a charged state. Optionally, a biasing member in one or more of the air compressors or liquid pumps may return other air compressors and/or liquid pumps to a first state. In some embodiments, a biasing member in the actuator mechanism returns the air compressor and/or liquid pumps to a first state. Still yet, if the air compressor and or liquid pump are electrically operated, they may be moved to the first state electrically.

In addition, parts described with respect to one embodiment may be combined with parts described with respect to other embodiments. For example, the "suck back" feature described with respect to pump 1000 may be incorporated into any of the other pumps, refill units or dispensers.

While the present invention has been illustrated by the description of embodiments thereof and while the embodiments have been described in considerable detail, it is not the intention of the applicants to restrict or in any way limit the scope of the appended claims to such detail. Additional advantages and modifications will readily appear to those skilled in the art. Moreover, elements described with one embodiment may be readily adapted for use with other embodiments. Therefore, the invention, in its broader aspects, is not limited to the specific details, the representative apparatus and/or illustrative examples shown and described. Accordingly, departures may be made from such details without departing from the spirit or scope of the applicants' general inventive concept.

We claim:

1. A disposable refill unit for a foam dispenser comprising;

a container;

a liquid pump secured to the container;

the liquid pump having a housing;

the pump housing having a cylindrical liquid inlet;

a liquid inlet valve having a wiper seal for contacting the wall of the cylindrical liquid inlet, a stem extending in the direction of fluid flow, a first projection member along the stem and a second projection member along the stem for retaining the liquid inlet valve in the cylindrical liquid inlet;

the liquid pump having a liquid chamber defined at least in part by the liquid inlet valve and a liquid outlet valve;

a liquid piston that reciprocates in the liquid chamber;

a mixing chamber located downstream of the liquid chamber;

an air inlet in fluid communication with the mixing chamber;

a sanitary seal located proximate the air inlet, the sanitary seal allows air to enter the mixing chamber and prevents liquid from exiting the mixing chamber through the air inlet.

2. The disposable refill unit of claim 1 further comprising a sleeve located at least partially within the liquid chamber and at least a portion of the liquid piston reciprocates within the sleeve.

3. The disposable refill unit of claim 1 wherein the sanitary seal is a wiper seal.

4. The disposable refill unit of claim 3 wherein the liquid outlet valve is a wiper seal.

5. The disposable refill unit of claim 4 wherein the sanitary seal and liquid outlet valve are positioned opposite of one another.

6. The disposable refill unit of claim 5 wherein the sanitary seal and liquid outlet valve are secured to a hollow stem.

7. The disposable refill unit of claim 6 further comprising an aperture in the hollow stem located between the sanitary seal and the liquid outlet valve.

8. The disposable refill unit of claim 1 wherein the liquid piston is movable to a plurality of positions within the liquid chamber and a head of the piston is located on one side of the outlet valve when the piston is in a first position and the head of the piston is located on the opposite side of the outlet valve when the piston is in a second position.

9. The disposable refill unit of claim 1 further comprising a suck back chamber in fluid communication with the mixing chamber.

10. A disposable refill unit for a foam dispenser comprising;

a container;

a liquid pump secured to the container;

the liquid pump having a liquid chamber defined at least in part by a liquid inlet valve and a liquid outlet valve;

a mixing chamber located downstream of the liquid chamber;

an air inlet in fluid communication with the mixing chamber;

a sanitary seal located proximate the air inlet, the sanitary seal allows air to enter the mixing chamber and prevents liquid from exiting the mixing chamber through the air inlet;

wherein the container, the liquid pump and the sanitary seal are disposed of after liquid is expelled from the container; and wherein the liquid outlet valve is a wiper seal and the sanitary seal is a wiper seal and wherein the liquid outlet valve allows fluid to flow in a first direction and the sanitary seal allows liquid to flow in a substantially opposite direction.

11. The disposable refill unit of claim 10 wherein the liquid inlet valve and the liquid outlet valve are offset from one another.

12. The disposable refill unit of claim 10 wherein the liquid outlet valve is located closer to the front of the refill unit than the liquid inlet valve.

13. The disposable refill unit of claim 10 wherein at least one of the inlet valve and outlet valve are located off of a center line of the container.

14. The disposable refill unit of claim 10 wherein the liquid inlet comprises a wiper seal having a stem located downstream of the wiper seal, wherein the stem comprises one or more projection members for securing the wiper seal in place.

15. The disposable refill unit of claim 10 further comprising a suck back chamber in fluid communication with the mixing chamber.

16. A disposable refill unit comprising:

a container of foamable liquid;

a pump secured to the container;

the pump having a pump housing;

an aperture through an upper surface of the pump housing;

a liquid inlet valve;

the liquid inlet valve including a stem portion;

the stem portion having a projection member;

the liquid inlet valve including a sealing member;

a pump chamber located within the pump housing, wherein the aperture extends from the upper surface of the pump housing to the pump chamber;

wherein the projection member of the liquid inlet valve stem is located at least partially within the pump chamber and the sealing member of the liquid inlet valve is located above the upper surface of the pump housing; and one or more liquid inlet passages located in the housing between the upper surface and the pump chamber;

wherein the sealing member is located upstream of the one or more liquid inlet passages.

17. The disposable refill unit of claim 16 further comprising a liquid outlet valve and an air inlet valve.

18. The disposable refill unit of claim 17 wherein the liquid outlet valve is a wiper seal that allows fluid to flow in a first direction and the air inlet valve is a wiper seal that allows air to flow in a second direction.

19. The disposable refill unit of claim 18 wherein the liquid outlet valve and air inlet valve are located on a hollow stem.

20. The disposable refill unit of claim 19 further comprising an aperture located in the stem between the liquid outlet valve and the air inlet valve.

* * * * *